US009599408B1

(12) United States Patent
Hartenstine et al.

(10) Patent No.: US 9,599,408 B1
(45) Date of Patent: Mar. 21, 2017

(54) LOOP HEAT PIPE EVAPORATOR INCLUDING A SECOND HEAT PIPE

(75) Inventors: John R. Hartenstine, Mountville, PA (US); William G. Anderson, Bound Brook, NJ (US); Michael J. DeChristopher, Leola, PA (US)

(73) Assignee: Advanced Cooling Technologies, Inc., Lancaster, PA (US)

( * ) Notice: Subject to any disclaimer, the term of this patent is extended or adjusted under 35 U.S.C. 154(b) by 400 days.

(21) Appl. No.: 13/385,704

(22) Filed: Mar. 3, 2012

(51) Int. Cl.
*F28D 15/00* (2006.01)
*F28D 15/04* (2006.01)

(52) U.S. Cl.
CPC ..... *F28D 15/04* (2013.01); *F28D 15/046* (2013.01)

(58) Field of Classification Search
CPC ..... F28D 15/04; F28D 15/046
USPC ..... 165/104.14, 104.21, 104.26
See application file for complete search history.

(56) References Cited

U.S. PATENT DOCUMENTS 3,563,309 A * 2/1971 Basiulis ..... F28D 15/06 165/104.26
3,681,843 A * 8/1972 Arcella et al. ..... 29/423
3,827,480 A * 8/1974 Gammel ..... H01L 23/427 165/104.14
4,474,170 A * 10/1984 McConnell ..... F24J 2/055 118/317
4,883,116 A * 11/1989 Seidenberg ..... F28D 15/043 122/366
4,899,810 A * 2/1990 Fredley ..... B64G 1/506 165/104.14
4,909,316 A * 3/1990 Kamei et al. ..... 165/104.26
5,219,516 A * 6/1993 Horner-Richardson et al. ..... 376/321
6,889,755 B2 * 5/2005 Zuo et al. ..... 165/104.26
7,775,261 B2 8/2010 Valenzuela
8,002,021 B1 * 8/2011 Zuo et al. ..... 165/80.4
2005/0145374 A1 * 7/2005 Dussinger et al. ..... 165/104.26
2005/0230085 A1 * 10/2005 Valenzuela ..... 165/104.26
2006/0213646 A1 * 9/2006 Hsu ..... 165/104.26
2007/0240852 A1 * 10/2007 Liu et al. ..... 165/104.14
2007/0267180 A1 * 11/2007 Asfia et al. ..... 165/104.26
2010/0155019 A1 * 6/2010 Zhou et al. ..... 165/60
2010/0163212 A1 * 7/2010 Chin ..... F28D 15/0266 165/104.26

(Continued)

FOREIGN PATENT DOCUMENTS

JP 2008008512 A * 1/2008

OTHER PUBLICATIONS

Riehl (Loop heat pipe performance enhancement using primary wick with circumferential grooves) ; Roger R. Riehl*, Nadjara dos Santos; Received Aug. 22, 2006; accepted Nov. 12, 2007.*

(Continued)

*Primary Examiner* — Len Tran
*Assistant Examiner* — Gordon Jones
(74) *Attorney, Agent, or Firm* — McNees Wallace & Nurick LLC

(57) ABSTRACT

An evaporator for a loop heat pipe with high input heat transfer. The heat transfer is attained by constructing a heat pipe on the loop heat pipe evaporator heat input surface. The heat pipe then distributes the heat from limited input areas over the entire surface of the loop heat pipe evaporator, and that entire evaporator surface functions as the loop heat pipe heat input area as opposed to limited smaller areas into which the heat usually enters.

7 Claims, 2 Drawing Sheets

(56) References Cited

U.S. PATENT DOCUMENTS

| | | | | |
|---|---|---|---|---|
| 2010/0300656 | A1* | 12/2010 | Lu | F28D 15/0266 165/104.26 |
| 2011/0000646 | A1* | 1/2011 | Hou | 165/104.26 |

OTHER PUBLICATIONS

JP2008008512A machine translation.*

* cited by examiner

LOOP HEAT PIPE EVAPORATOR INCLUDING A SECOND HEAT PIPE

BACKGROUND OF THE INVENTION

This invention deals generally with loop heat pipe evaporators, and more specifically with increasing the heat transfer from the location of heat input to the evaporator.

One of the limitations for loop heat pipes is related to the heat input to the evaporator. Conventional loop heat pipe primary wicks have a heat flux limit at approximately 25 W/cm$^2$. Excessive heat flux causes boiling inside the wick, which disrupts liquid return flow and results in unstable operation of the loop heat pipe and dry-out.

The maximum heat flux in the evaporator wick and typically in the entire loop heat pipe system is found at the interface between the wick and evaporator casing. At this location, heat transfer can occur by two paths, by conduction through the liquid—saturated wick or by convection of the vapor in the vapor grooves that are along the casing inner surfaces and/or the wick outer surfaces. To transfer heat by convection the vapor must collect the heat from the evaporator casing and then deposit this heat in the wick. This is a poor heat transfer path because of the relatively low convective heat transfer coefficient of the vapor flow. Conduction requires heat to move from the location of heat input through the evaporator casing directly to the liquid-saturated wick and is a much more favorable method. However, the vapor grooves are located between the wick and evaporator casing. As a result, they reduce the heat transfer area available for conduction. This reduction in area concentrates heat flux, and as a result the highest heat flux occurs at this point. This problem is aggravated by non-uniform heat flux distribution, which further concentrates the heat flux. To increase the heat flux tolerated at the heat input location of the loop heat pipe, this heat flux concentration needs to be reduced.

Therefore the purpose of the present invention is to produce a more uniform heat flux at the interface between the loop heat pipe wick and evaporator casing.

SUMMARY OF THE INVENTION

The present invention is an evaporator for a loop heat pipe with improved input heat transfer. The improved heat transfer is attained by constructing an independent heat pipe on the entire evaporator heat input surface. The heat pipe then distributes the heat from the limited heat input areas to the entire surface of the loop heat pipe evaporator, and the entire evaporator surface functions in the loop heat pipe as opposed to the limited smaller areas into which the heat usually enters.

Prior art loop heat pipe evaporators typically have cylindrical casings with porous wick on the inside surface of the cylinder and axially oriented grooves where the porous wick meets the cylinder inside wall. The present invention adds an annular heat pipe as a thermal spreader in good thermal contact with the outer surface of the evaporator casing. Such a heat pipe can be constructed so that it uses the evaporator casing wall as one side of the heat pipe or as an independent structure bonded to the outer wall of the evaporator casing.

In either type of structure, the heat pipe outer wall acts as the heat input surface, and the heat pipe wick on the inside of the heat pipe outer wall at the heat input area produces vapor that travels throughout the entire heat pipe and condenses in near uniform fashion on the entire inside surface of the heat pipe that is in contact with the evaporator of the loop heat pipe. Thus, the heat from the limited heat input area of the heat pipe is transferred to the entire loop heat pipe evaporator heat input surface with very little thermal resistance.

Simply stated, the added heat pipe of the present invention spreads the heat so that the effect is the same as if the heat entering the loop heat pipe evaporator had been uniformly applied over the entire loop heat pipe evaporator surface rather than a very limited area. Since, as previously noted, conventional loop heat pipe wicks have a heat flux limit of approximately 25 W/cm$^2$ and heat pipe wick structures have heat flux limits in the range of 75-500 W/cm$^2$, the heat pipe accepts the higher heat input with much higher heat flux capability, and its heat spreading action increases the affected input heat surface area of the loop heat pipe evaporator so that it has no problem accepting the greater total heat input.

DETAILED DESCRIPTION OF THE INVENTION

Figure 1:
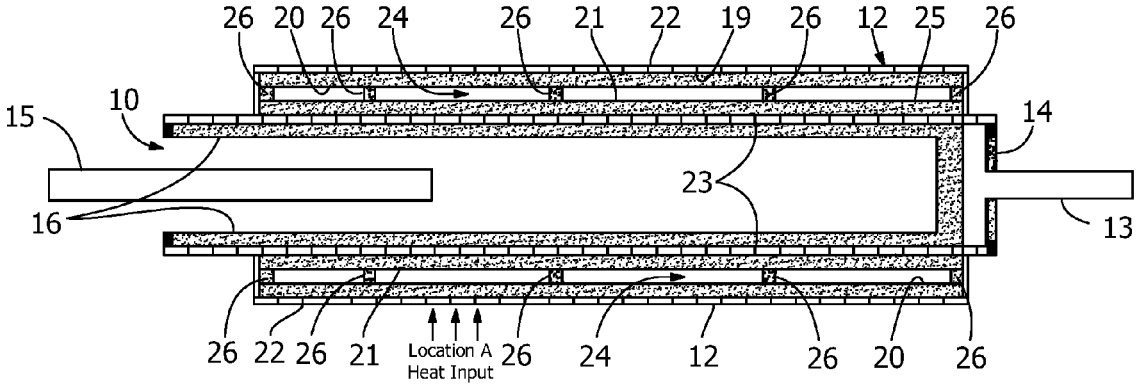
FIG. 1 is a longitudinal cross section view of the preferred embodiment of the invention along the axis of a loop heat pipe evaporator.
Figure 2:
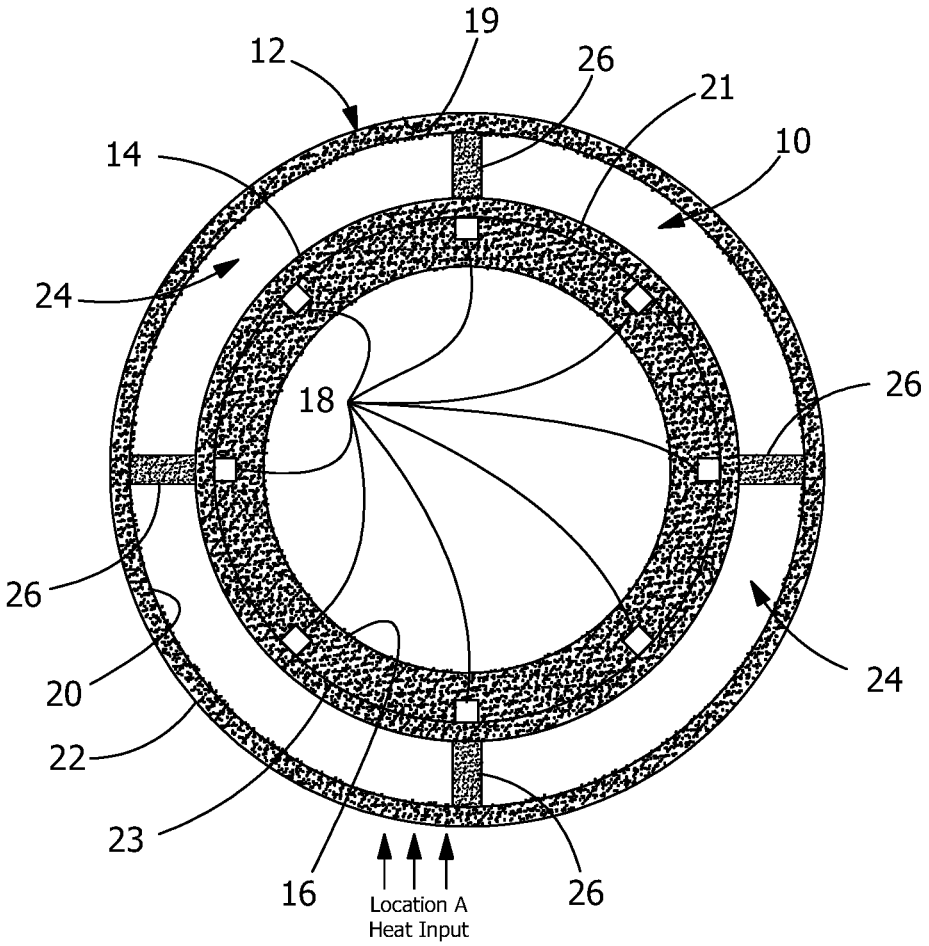
FIG. 2 is a cross section view of the preferred embodiment of the invention across the axis of a loop heat pipe evaporator.

FIG. 1 is a longitudinal cross section view of the preferred embodiment of the invention along the axis of loop heat pipe evaporator 10, and FIG. 2 is a cross section view of the preferred embodiment of the invention across the axis of loop heat pipe evaporator 10.

As shown in both figures, heat pipe 12 is attached to casing wall 14 of evaporator 10, and is constructed so that it uses evaporator casing wall 14 as one wall of heat pipe 12. However, heat pipe 12 can also be constructed as a separate structure which is bonded to casing wall 14 of evaporator 10. It should also be appreciated that although in FIG. 2 evaporator 10 is shown as a cylinder and heat pipe 12 as an annular structure around cylindrical evaporator 10, both evaporator 10 and heat pipe 12 can have different shapes.

Loop heat pipe evaporator 10 is shown with the conventional structure of such an evaporator. Prior art loop heat pipe evaporators typically have cylindrical casings 14 with capillary wick 16 on the inside surface of the cylinder and axially oriented grooves 18 (FIG. 2) where wick 16 meets the casing inside wall surface. Vapor outlet pipe 13 and liquid return pipe 15 are also standard features for connecting loop heat pipe evaporator 10 to the condenser of the loop heat pipe.

Except for its annular structure, heat pipe 12 also has a reasonably conventional structure for a heat pipe. It includes evaporator wick 20 on the interior surface 19 of a first pipe or casing wall 22 and condenser wick 21 on the interior surface 25 of a second pipe or casing wall 23, with vapor space 24 between wicks 20 and 21.

However, additional wick structures are needed in heat pipe 12 because of its annular configuration. Since evaporator wick 20 and condenser wick 21 basically are isolated concentric cylinders, they have no capillary path between them to return condensed liquid from condenser wick 21 back to evaporator wick 20 for continuing operation, except with the addition bridge wicks 26 as shown in FIG. 2. The number of bridge wicks 26 and their locations included in the structure will depend on the specific application. FIG. 1 also shows possible locations for bridge wicks 26 at the ends of annular heat pipe 12, however those locations have limited availability.

The operation of the invention is straight forward. Heat input in even such a limited access as location A is actually applied to exterior wall 22 of annular heat pipe 12 where it evaporates liquid from evaporator wick 20. Then, as is conventional for heat pipe operation, the vapor resulting from the evaporation moves throughout heat pipe vapor space 24, and when it contacts the cooler condenser wick 21 on heat pipe casing inner wall 23, the vapor condenses transferring the input heat to heat pipe casing inner wall 23. The input heat has thereby been transferred from the very limited area at heat input location A to the entire casing wall 14 of evaporator 10 with virtually no heat loss because of the operation of heat pipe 12. This heat spreading action thereby increases the affected input heat surface area of the loop heat pipe evaporator so that it has no problem accepting a much greater total heat input.

It should be appreciated that while in the preferred embodiment shown heat pipe inner wall 23 also functions as the heat input wall of loop heat pipe evaporator 10, essentially this same structure could be constructed as an independent annular heat pipe structure with its inner wall bonded to the outer wall of the evaporator casing. The only difference being that wall 23 would be constructed of two walls bonded together rather than a single integrated wall as shown. It is also important to understand that heat input location A is merely one example. There can be multiple heat input locations, and they can be areas of larger or smaller sizes.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. A loop heat pipe evaporator comprising:

a loop heat pipe having a casing evaporator wall forming an enclosure so that the evaporator wall has inside and outside surfaces, a loop heat pipe evaporator wick attached to the inside surface of the evaporator wall;

axially oriented grooves in the loop heat pipe evaporator wick where the loop heat pipe evaporator wick meets the inside surface of the casing evaporator wall;

an annular heat pipe formed as a sealed enclosure with a first heat pipe wall and a second heat pipe wall, the annular heat pipe positioned around and extending over the entire grooved length of the loop heat pipe evaporator wick;

the first heat pipe wall having a heat pipe evaporator wick attached to an inside surface of the first heat pipe wall and the second heat pipe wall having a heat pipe condenser wick attached to an inside surface of the second heat pipe wall;

a vapor space within the seated enclosure;

the first heat pipe wall including at least one heat input location;

the second heat pipe wall being integral with or in contact with an area on the outside surface of the casing evaporator wall of the loop heat pipe, wherein the area of contact between the second heat pipe wall and the outside surface of the loop heat pipe casing evaporator wall is larger than the area of the heat input on the first heat pipe wall;

the annular heat pipe operating to spread input heat from the at least one heat input location to the entire area of the loop heat pipe casing evaporator wall surface in contact with the second heat pipe wall; and the heat pipe evaporator wick and the heat pipe condenser wick are isolated concentric cylinders, the annular heat pipe having bridge wicks spaced periodically along a length of the annular heat pipe, respective bridge wicks are spaced from ends of the annular heat pipe, the bridge wicks extend between the heat pipe evaporator wick and the heat pipe condenser wick, the bridge wicks provided to return condensed liquid from the heat pipe condenser wick to the heat pipe evaporator wick.

2. The loop heat pipe evaporator of claim 1 in which the loop heat pipe casing evaporator wall is a cylinder.

3. The loop heat pipe evaporator of claim 1 in which the loop heat pipe evaporator casing includes a liquid input pipe and a vapor output pipe.

4. The loop heat pipe evaporator of claim 1 in which there is at least one capillary transfer path between the capillary wicks of the first and second heat pipe walls.

5. A loop heat pipe evaporator comprising:

a loop heat pipe having a casing evaporator wall forming an enclosure so that the evaporator wall has inside and outside surfaces, a loop heat pipe evaporator wick attached to the inside surface of the evaporator wall;

axially oriented grooves in the loop heat pipe evaporator wick where the loop heat pipe evaporator wick meets the inside surface of the casing evaporator wall;

an annular heat pipe formed as a sealed enclosure with a first heat pipe wall and a second heat pipe wall, the annular heat pipe positioned around and extending over the entire grooved length of the loop heat pipe evaporator wick;

the first heat pipe wall having a heat pipe evaporator wick attached to an inside surface of the first heat pipe wall and the second heat pipe wall having a heat pipe condenser wick attached to an inside surface of the second heat pipe wall;

a vapor space within the sealed enclosure;

the first heat pipe wall including at least one heat input location;

the second heat pipe wall being the same wall as the casing evaporator wall; and the annular heat pipe operating to spread input heat from the at least one heat input location to the entire length of the loop heat pipe casing evaporator wall in contact with the second heat pipe wall; and the heat pipe evaporator wick and the heat pipe condenser wick are isolated concentric cylinders, the annular heat pipe having bridge wicks spaced periodically along a length of the annular heat pipe, respective bridge wicks are spaced from ends of at least one additional annular heat pipe, the bridge wicks extend between the heat pipe evaporator wick and the heat pipe condenser wick, the bridge wicks provided to return condensed liquid from the heat pipe condenser wick to the heat pipe evaporator wick.

6. The loop heat pipe evaporator of claim 5 in which the loop heat pipe evaporator casing includes a liquid input pipe and a vapor output pipe.

7. The loop heat pipe evaporator of claim 5 in which there is at least one capillary transfer path between the capillary wicks of the first and second heat pipe walls.

* * * * *